US006966362B2

(12) United States Patent
Tanaka et al.

(10) Patent No.: US 6,966,362 B2
(45) Date of Patent: Nov. 22, 2005

(54) COOLING DEVICE

(75) Inventors: Hiroshi Tanaka, Toyoake (JP); Takahide Ohara, Okazaki (JP); Kazutaka Suzuki, Kariya (JP); Yuhei Kunikata, Kariya (JP); Hiroo Yamaguchi, Toyohashi (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/953,697

(22) Filed: Sep. 29, 2004

(65) Prior Publication Data

US 2005/0056406 A1 Mar. 17, 2005

Related U.S. Application Data

(62) Division of application No. 10/047,914, filed on Jan. 15, 2002, now Pat. No. 6,810,947.

(30) Foreign Application Priority Data

Jan. 16, 2001 (JP) ..... 2001-008165

(51) Int. Cl.[7] ..... F28D 15/02

(52) U.S. Cl. ..... 165/104.33; 165/104.21; 361/700; 257/715

(58) Field of Search ..... 165/104.13, 104.14, 165/104.21, 104.33, 80.4, 173, 175, 176; 257/715; 361/700

(56) References Cited

U.S. PATENT DOCUMENTS

| | | | | |
|---|---|---|---|---|
| 5,453,641 | A | 9/1995 | Mundinger et al. | |
| 5,587,880 | A | 12/1996 | Phillips et al. | |
| 5,678,422 | A | 10/1997 | Yoshii et al. | |
| 5,823,248 | A | 10/1998 | Kadota et al. | |
| 6,005,772 | A | 12/1999 | Terao et al. | |
| 6,321,831 | B1 * | 11/2001 | Tanaka et al. | 165/104.33 |
| 6,341,645 | B1 * | 1/2002 | Tanaka et al. | 165/104.33 |
| 6,341,646 | B1 * | 1/2002 | Tanaka et al. | 165/104.33 |
| 6,360,814 | B1 * | 3/2002 | Tanaka et al. | 165/104.33 |
| 6,863,119 | B2 * | 3/2005 | Sugito et al. | 165/104.33 |

FOREIGN PATENT DOCUMENTS

JP 10-308486 11/1998

* cited by examiner

*Primary Examiner*—John Rivell
(74) *Attorney, Agent, or Firm*—Harness, Dickey & Pierce, PLC

(57) ABSTRACT

In a cooling device, a condensation unit is constructed by stacking plural unit plates and two outer plates. The plural unit plates are superimposed in a plate-thickness direction between the outer plates, and three sheets of unit plates are also arranged in the planar direction. The radiating fins are provided such that the width of the base is substantially equal to the width of the unit plate, and are arranged in parallel on one of the outer plates in the same manner as the unit plate. According to this structure, the number of the unit plates arranged in parallel with the outer plates and the number of the radiating fins are increased or decreased, so that it is possible to easily change the size of a radiating unit in accordance with a necessary cooling capacity.

13 Claims, 19 Drawing Sheets

COOLING DEVICE

CROSS-REFERENCE TO RELATED APPLICATION

This application is a divisional of U.S. patent application Ser. No. 10/047,914 filed Jan. 15, 2002 now U.S. Pat. No. 6,810,947. This application is related to and claims priority from Japanese Patent Application No. 2001-8165 filed on Jan. 16, 2001, the contents of which are hereby incorporated by reference.

FIELD OF THE INVENTION

The present invention relates to a cooling device for cooling a heat-generating element by movement of latent heat based on boiling and condensation of refrigerant.

BACKGROUND OF THE INVENTION

In order to cool elements for an electronic unit such as computer chips, air-cooling fins made of aluminum and the like have frequently used. However, since the heat-generating amount has been increasing year after year with improvement in performance of those elements, the air-cooling fins have become difficult to cope with them.

Thus, there has been developed a cooling device which transmits heat of those elements to refrigerant to cool those elements by means of movement of-latent heat based on the boiling and condensation of the refrigerant.

An example of a cooling device using the refrigerant has been disclosed in, for example, Japanese Patent Application Laid-Open No. 10-308486. The cooling device disclosed in this official gazette includes, as shown in FIG. 7, a refrigerant container 100 constructed by stacking a plurality of sheets of plates, and radiating fins 110 mounted to the refrigerant container 100 so as to contact a radiating surface thereof.

The above-described cooling device is capable of coping with various cooling capacity by increasing or decreasing a number of sheets of the plates constituting the refrigerant container 100 to thereby change the height of the refrigerant container 100. However, since the surface area of the plates is constant, it is difficult to change the shape of the radiating fins 110 extensively even if the capacity of the refrigerant container 100 is changed. More specifically, in the radiating fins 110 shown in FIG. 7, an extrusion production of aluminum is generally used. Accordingly, in order to change the shape of the radiating fins 110, the need for designing a new extrusion die arises, resulting in very high cost.

Although it is comparatively easy to change the height of the refrigerant container 100, when the heat receiving area and the radiating area are greatly changed according to the number of heat-generating elements 120 or the heat-generating amount thereof, the need for changing the basic size of the plates arises. Therefore, expense required for a press die for manufacturing the plates will become expensive.

As another example of the previously known cooling devices, there is also known a cooling device 500, as shown in FIG. 26, that includes a refrigerant container 510, and a radiating core portion 520 having tubes 540 connected to the refrigerant container 510 and a header tank 560 connected to the other side ends of the tubes 540. The refrigerant container 510 and the header tank 560 are constructed of plural sheets of stacked plates, and are connected by inserting a member into apertures formed in the plates.

In the cooling device 500, a balance between refrigerant-side cooling capability to be adjusted by pressure loss of refrigerant passing through each tube 540, and air-side cooling capability to be adjusted by flow resistance of air passing through a radiating core portion 520 is set, so that the radiating capability of the cooling device 500 is adjusted. As one of means for adjusting the pressure loss of the refrigerant and the air-flowing resistance, an interval of the tubes 540 can be changed. However, in order to change the interval of the tube 540, it is necessary to change also the number of apertures in the plates, into which tubes 540 are to be inserted. For this reason, expense required for a press die for manufacturing the plates becomes expensive with the number change of apertures in the plates.

Further, in the cooling device 500, if the refrigerating container 510 and the header tank 560 are made to be close to each other or if the interval of the tubes 540 is narrow, it is difficult to insert the assembling jig. Particularly, in order to assemble the tube 540 positioned at the central part of the radiating core portion 520, a complicated operation will be needed.

SUMMARY OF THE INVENTION

The present invention has been achieved in view of the above-described problems, and is aimed to provide a cooling device capable of changing the size easily and at low cost in accordance with necessary cooling capacity.

In a cooling device according to the present invention, plural unit plates having the same shape are stacked in a plate-thickness direction, and are sandwiched between the two outer plates. On the surface of one outer plate among the two outer plates, radiating fins having the substantially same width as the unit plate are disposed. When refrigerant vapor boiled and vaporized by heat from a heat-generating element flows in slits provided on each unit plate, heat of the refrigerant vapor is radiated from the one outer plate to the outside through the radiating fins. Relative to the two outer plates, two or more sheets of the unit plates are arranged in parallel. Further, with respect to one outer plate, radiating fins are arranged in parallel by the number corresponding to the unit plates arranged in parallel.

According to this structure, it is possible to readily increase or decrease the number of the unit plates arranged in parallel relative to the outer plates, and the number of the radiating fins, in accordance with the necessary cooling capacity. Even when the size of the cooling device changes, common components can be used without the need for changing the shape of the unit plate and radiating fins. Therefore, it is possible to greatly reduce the component manufacturing cost, and to easily change the size of the cooling device.

Preferably, the size of the header is changed in accordance with the number of the unit plates arranged in parallel on the two sheets of outer plates. For this reason, it is possible to easily secure necessary cooling performance.

The cooling device includes a boiling unit for storing therein liquid refrigerant, and a condensation unit for condensing refrigerant vapor boiled and vaporized in the boiling unit. The heat-generating member is attached on a surface of the boiling unit. The condensation unit is constructed by stacking plural sheets of the unit plates between the two sheets of the outer plates, and the boiling unit and the condensation unit are coupled together through a pipe. Accordingly, it is easy to change the size of the condensation unit, and it is possible to easily change the radiating performance by the change of the size. Since the boiling unit and the condensation unit are coupled together through the pipe, it is also possible to change the radiating performance by changing the number of pipes.

A cooling device according to the present invention includes a plurality of tubes inside which refrigerant passes, a refrigerant container in which refrigerant is sealed, and a header tank. The heat-generating element is mounted on a surface of the refrigerant container, and one side ends of the tubes communicates with the refrigerant container. The other side ends of the tubes are connected to the header tank to be communicated with each other. In this cooling device, refrigerant within the refrigerant container is boiled and vaporized by the heat from the heat-generating element, and flows into the tubes to perform heat-exchange with the outside air. A core unit has a tube group consisting of the tubes arranged in parallel, and unit plates in which both side ends of the tube group are inserted respectively. Here, each of the unit plates is suitable for the size of each tube group. In the cooling device, a plurality of the core units are arranged in accordance with a necessary cooling capacity.

According to this structure, the number of the core units is changed or core units having different cooling performance are combined, so that it is possible to easily adjust the cooling performance. Since the tubes constituting each core plate are arranged in parallel, it is easy to insert a jig between both tubes, and there is no need for any complicated assembling operation. Particularly, according to the present invention, the plural core units in which the tubes are installed to the unit plates are arranged to construct the cooling device. Therefore, no complicated operation is needed to install the tube at the central part of the cooling device even if the tube interval is narrow or plural core units having different tube intervals are combined.

Preferably, the tube at the outermost side in the tube group in a tube-laminating direction, has an insert to be inserted into the unit plate. For this reason, it is possible to fix the unit plate and the unit plate by the insert, and to prevent the tubes from being removed during transportation and others.

Among the flat plate members, a flat plate member arranged on the outermost side has a pawl, and the plural flat plate members are fixed by the pawl. Thereby, plural sheets of plates stacked in order to constitute the refrigerant container or the header tank can be fixed by using the pawl.

Each of the fins has a plate-like base portion extending in an air-flowing direction, and a wall portion bent from the base portion which abuts against the wall surfaces of the tubes. In addition, the fins are stacked in a tube-longitudinal direction. By inserting the fins in the air-flowing direction, the fins can be readily installed between the tubes and there is no need for any complicated operation.

BRIEF DESCRIPTION OF THE DRAWINGS

FIG. 11A shows a state in which the core unit is installed to the refrigerant container, and FIG. 11B shows a state in which the header tank is installed to the core unit;

FIG. 15A shows a state in which the core unit is installed to the refrigerant container, FIG. 15B shows a state in which the header tank is installed to the core unit, and FIG. 15C is an essential cross-sectional view of the present modification;

DETAILED DESCRIPTION OF THE PREFERRED EMBODIMENTS

Next, with reference to the drawings, plural embodiments according to the present invention will be now described.

(First Embodiment)

Figure 1:
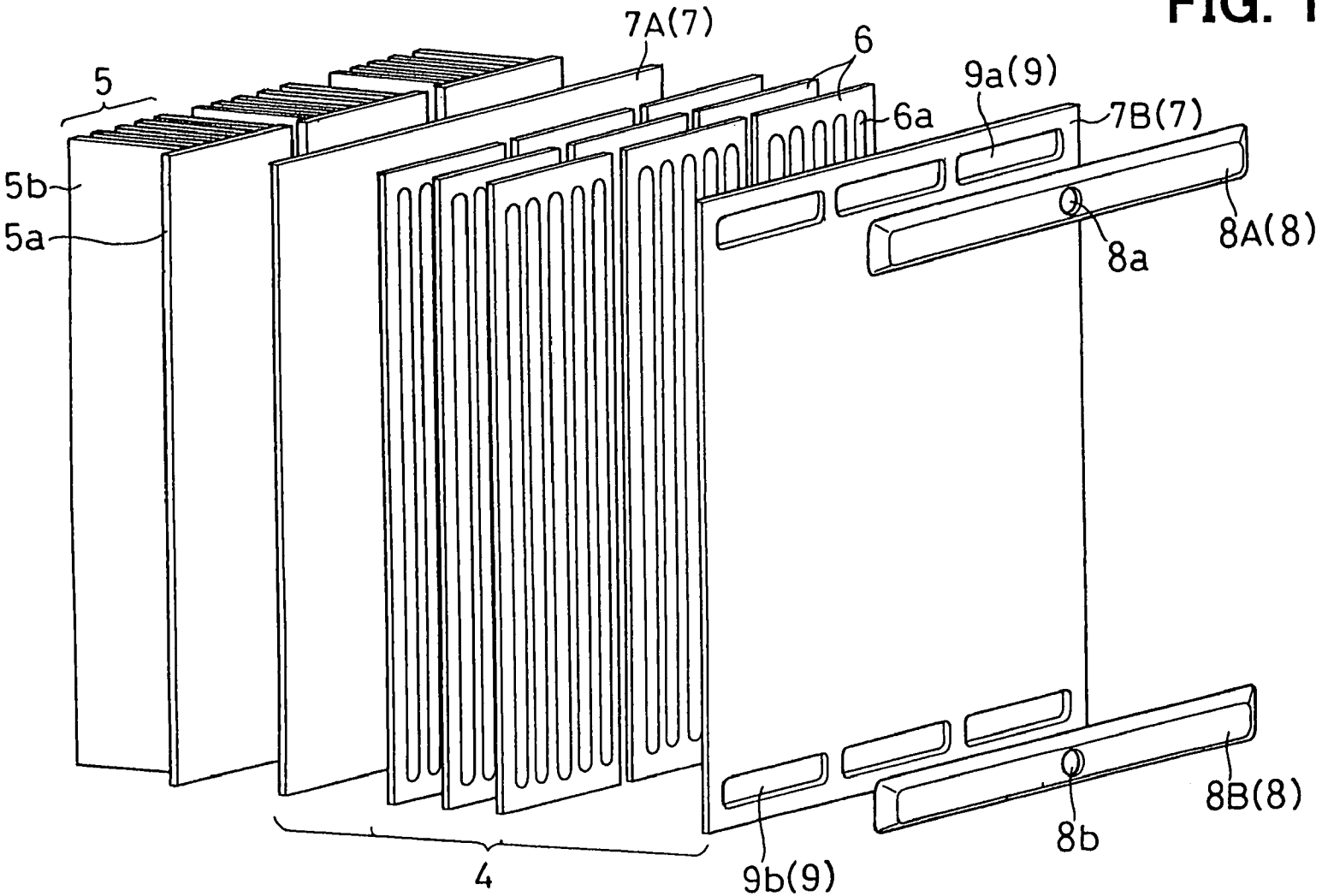
FIG. 1 is am exploded perspective view of a radiating unit (a condensation unit and radiating fins) according to a first embodiment.
Figure 2:
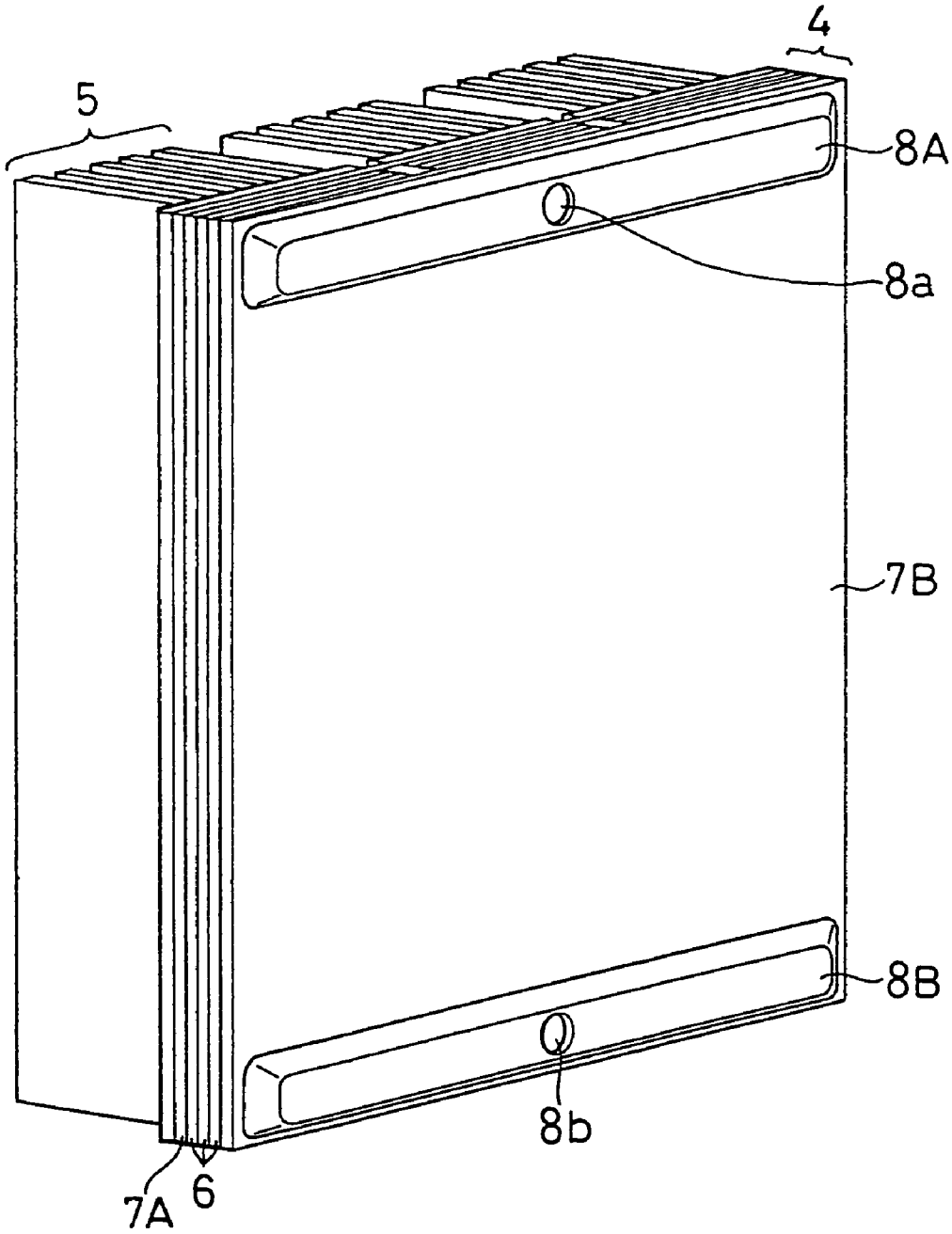
FIG. 2 is a perspective view of the radiating unit according to the first embodiment in an assembled state.

FIG. 1 is an exploded perspective view of a radiating unit (a condensation unit 4 and radiating fins 5), and FIG. 2 is a perspective view of the radiating unit in an assembled state.

Figure 3:
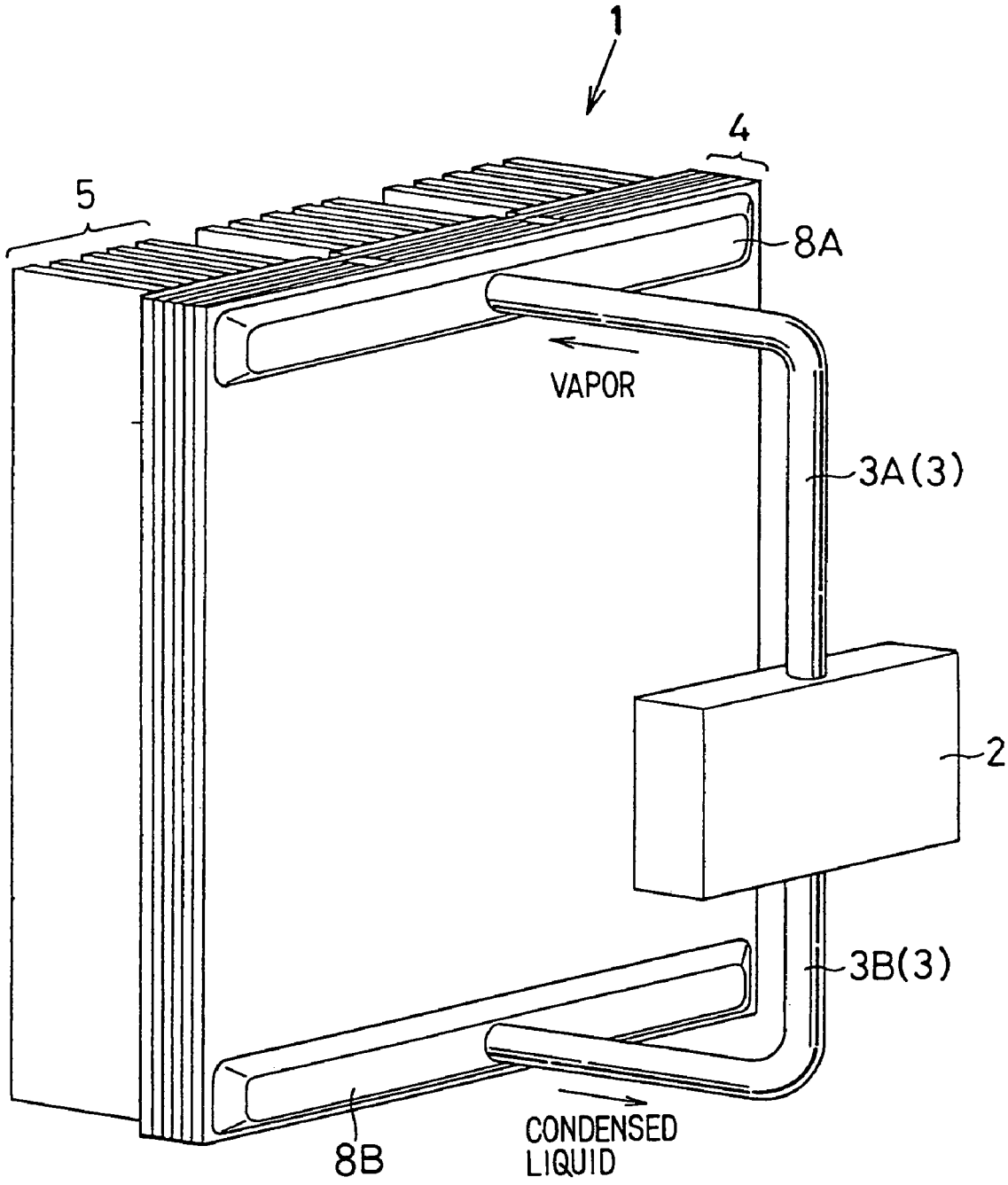
FIG. 3 is a perspective view showing a general shape of a cooling device according to the first embodiment.

A cooling device 1 according to the present embodiment is used to cool a heat-generating element (not shown) by movement of latent heat based on boiling and condensation of refrigerant. As shown in FIG. 3, the cooling device 1 is constructed by a boiling unit 2 on which the heat-generating element is mounted, a condensation unit 4 to be coupled to this boiling unit 2 through a pipe 3 (3A, 3B), and radiating fins 5. In this respect, the condensation unit 4 and the radiating fins 5 are assembled as shown in FIG. 2 to constitute a radiating unit.

Since material to be used for the boiling unit 2, the condensation unit 4 and the pipe 3 (3A, 3B) is, for example, aluminum, this cooling device 1 is manufactured by integral brazing after each unit is assembled.

The boiling unit 2 is a thin box-shaped container. A heat-generating element (e.g., computer chips) is mounted onto the surface of the boiling unit 2, and liquid refrigerant that is boiled and vaporized by heat from the heat-generating element is stored within. On the top surface and the bottom surface of the container forming the boiling unit 2, mounting holes (not shown) for mounting the pipe 3 respectively are opened.

The pipe 3 includes a vapor pipe 3A for sending refrigerant vapor obtained by boiling and vaporizing in the boiling unit 2 to the condensation unit 4, and a condensation pipe 3B for returning liquid refrigerant cooled and condensed in the condensation unit 4 into the boiling unit 2.

As shown in FIG. 1, the condensation unit 4 is constructed by plural sheets of unit plates 6, two sheets of outer plates 7 (7A, 7B), and a pair of headers 8 (8A, 8B).

In each unit plate 6, as shown in FIG. 1, a plurality of slits 6*a* constituting a condensation passage are opened to extend in the longitudinal direction of the plate (up-down direction of FIG. 1). Between the two outer plates 7, plural unit plates 6 are superimposed in the direction of plate thickness, and two or more sheets (three sheets in FIG. 1) are also arranged in parallel in the direction of the plane. Each of the two outer plates 7 is provided to have the substantially same size as the general shape of these three sheets of unit plates 6 arranged in parallel. One outer plate 7A is connected to the radiating fins 5.

On the other outer plate 7B, at both end portions of the plate which correspond to the longitudinal direction of the unit plate 6 as shown in FIG. 1, there are provided six apertures 9 in total at three places each. The apertures 9 communicate to both end portions of slits 6*a* formed on the unit plates 6, and are provided correspondingly every three sheets of the unit plates 6 arranged in parallel.

In the following description, three apertures 9 opened at the upper end portion of the other outer plate 7B are referred to as vapor inlets 9*a* respectively, and three apertures 9 opened at the lower end portion of the other outer plate 7B are referred to as liquid outlets 9*b* respectively.

The header 8 includes a vapor-side header 8A for communicating with each of the above-described vapor inlets 9*a*, and a liquid-side header 8B for communicating with each of the liquid outlets 9*b*. At the central parts of the vapor-side header 8A and the liquid-side header 8B, there are opened mounting holes 8*a*, 8*b* for mounting the pipe.3 (3A, 3B). The radiating fins 5 are, for example, extruded by aluminum. On a base 5*a* of the radiating fin 5, a plurality of radiating plates 5*b* are provided so as to stand upright at regular intervals. These radiating fins 5 are provided such that the width of the base 5*a* becomes substantially equal to the width of the unit plate 6, and are arranged in parallel on the one outer plate 7A as in the arrangement of the unit plates 6.

Next, an operation according to the present embodiment will be now described.

Refrigerant vapor that has boiled and vaporized by receiving heat from the heat-generating element in the boiling unit 2 flows into the vapor-side header 8A through the vapor pipe 3A, and flows into the slits 6*a* in each unit plate 6 through the vapor inlets 9*a*. The refrigerant vapor flowing into each slit 6*a* radiates heat for condensation while flowing downward by gravity. After flowing into the liquid-side header 8B through the liquid outlets 9*b*, the refrigerant liquid flows back into the boiling unit 2 through the condensation pipe 3B.

The heat-generating element is cooled by the movement of latent heat based on boiling and condensation of the refrigerant, and condensation latent heat of the refrigerant is radiated to the atmosphere from the one outer plate 7A through the radiating fins 5.

The condensation unit 4 according to the first embodiment is provided with two or more sheets of unit plates 6 arranged in parallel between the outer plates 7. On the one outer plate 7A, radiating fins 5 are disposed so as to be arranged in parallel.

Therefore, by increasing or decreasing the number of the unit plates 6 arranged in parallel with the outer plates 7 and the number of the radiating fins 5, it is possible to easily change the constitution (size) of the radiating unit (condensation unit 4 and radiating fins 5) in accordance with the necessary cooling capacity. In this case, since there is no need for changing each shape of the unit plate 6 and the radiating fins 5 to be used, but common components can be used, an extrusion die for forming each radiating fin 5 and a press die for manufacturing each unit plate 6 can be used in common, and the component manufacturing cost can be reduced by a large amount.

When the radiating fins 5 are formed by extrusion, the die cost can be reduced because a narrow extrusion die can be used.

(Second Embodiment)

Figure 4:
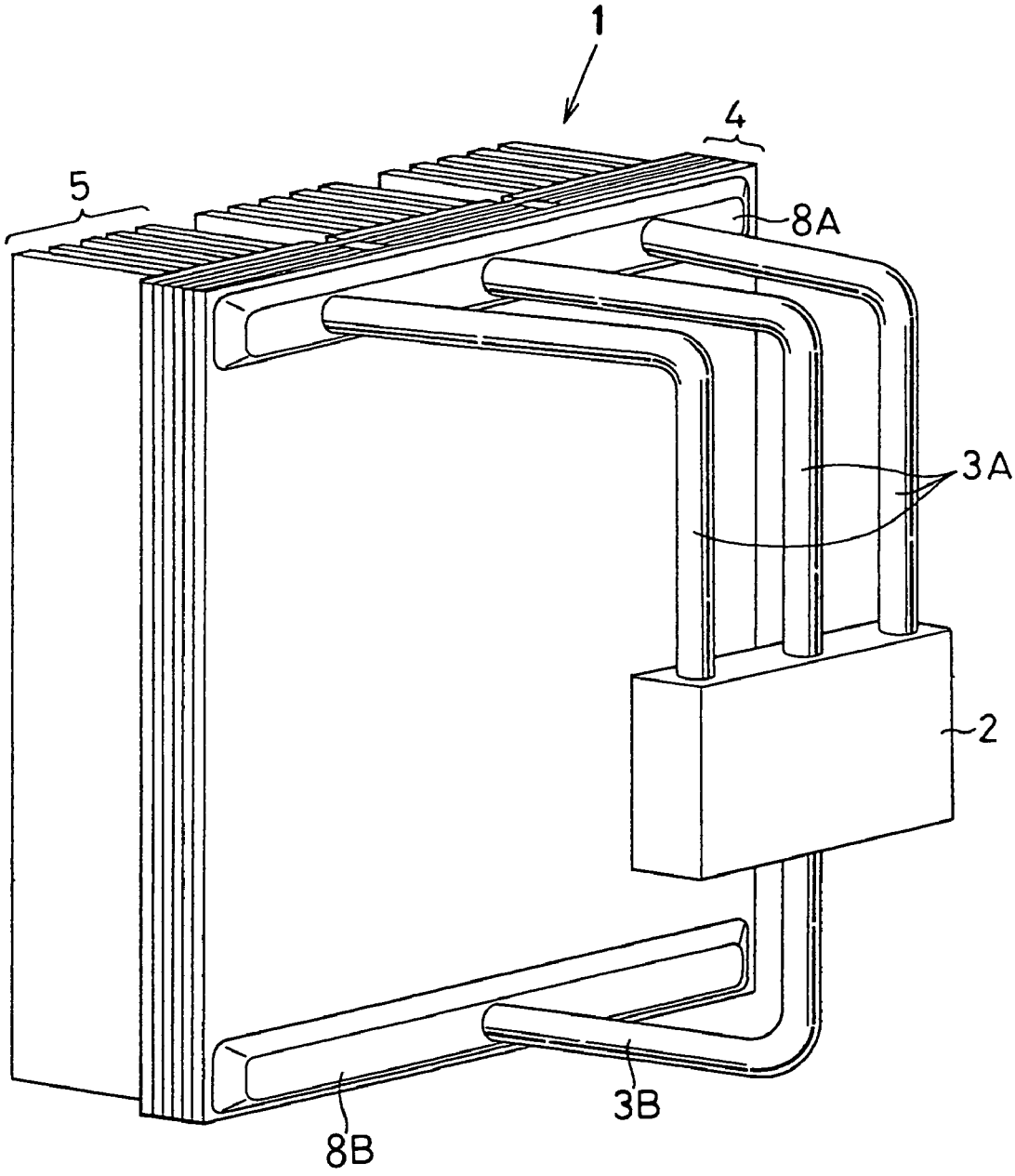
FIG. 4 is a perspective view showing a general shape of a cooling device according to a second embodiment.

FIG. 4 is a perspective view showing a general shape of the cooling device 1.

In the cooling device 1 according to the second embodiment, a plurality of vapor pipes 3A or condensation pipes 3B are used to couple the boiling unit 2 to the condensation unit 4.

By using three vapor pipes 3A, for example, as shown in FIG. 4, it is possible to make a flow of the refrigerant vapor flowing out from the boiling unit 2 smoother. Therefore, the refrigerant circulation can be favorably performed in the cooling device 1 to improve the heat dissipation performance.

(Third Embodiment)

Figure 5:
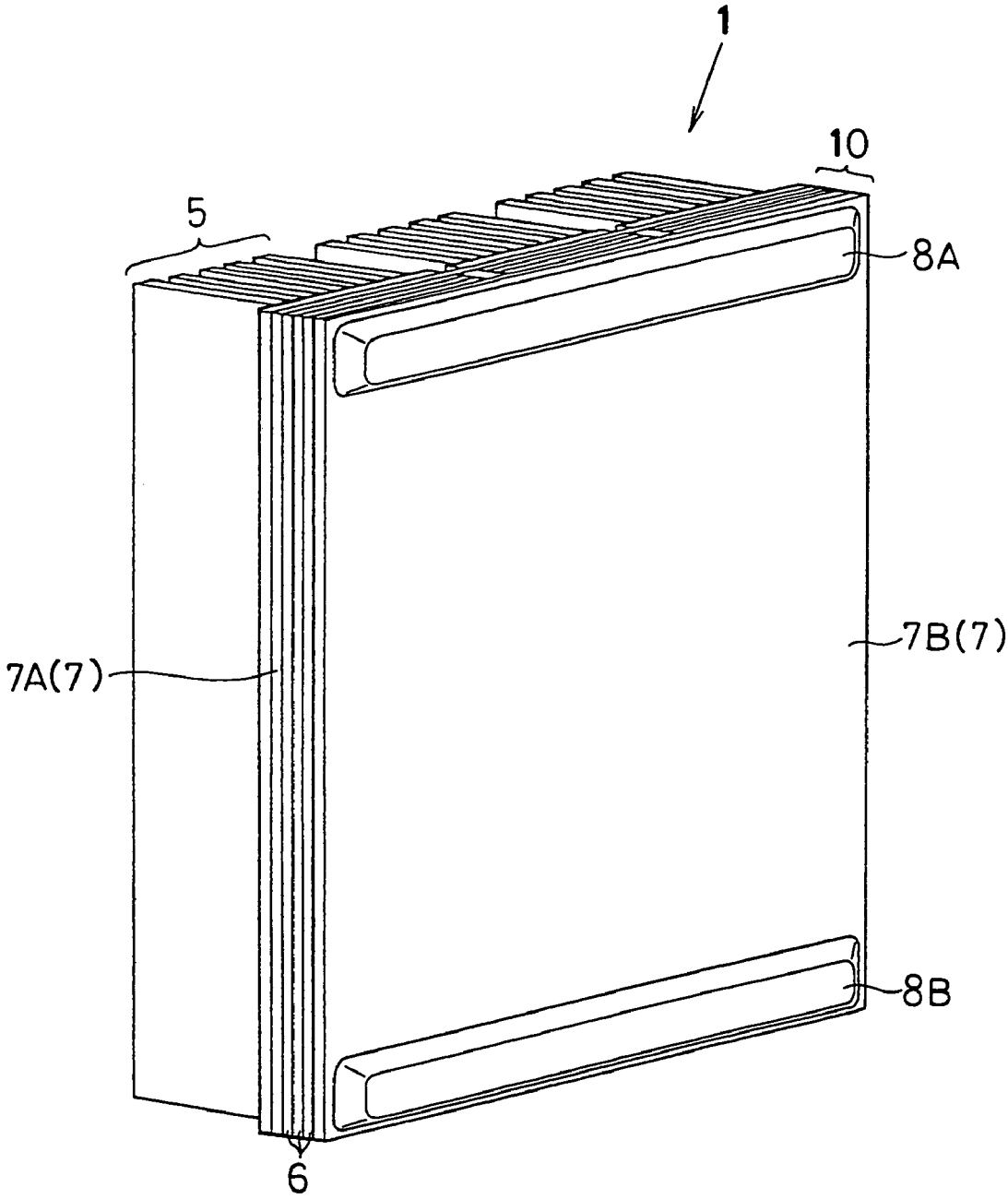
FIG. 5 is a perspective view showing a general shape of a cooling device according to a third embodiment.

FIG. 5 is a perspective view showing a general shape of a cooling device 1 of the third embodiment.

In the cooling device 1 according to the third embodiment, two sheets of outer plates 7 and plural sheets of unit plates 6 are stacked to thereby form a hermetically-sealed refrigerant container 10. Specifically, the structure of the refrigerant container 10 is formed such that within this refrigerant container 10, boiling and condensation of refrigerant is repeated. In other words, the structure of the condensation unit 4 described in the first embodiment is applied to the refrigerant container 10.

In this respect, as in the first embodiment, a plurality of radiating fins 5 are arranged in parallel onto the one outer plate 7A. On the surface of the other outer plate 7B of the refrigerant container 10, a heat-generating element (not shown) is attached.

Even in the third embodiment, the number of the unit plates 6 to be arranged in parallel with the outer plate 7 is increased or decreased, whereby it is possible to easily change the constitution (size) of the refrigerant container 10 in accordance with the necessary cooling capacity, and to easily change also the number of the radiating fins 5.

In this case, since there is no need for changing the shape of each unit plate 6 and each radiating fin 5 to be used, but common components can be used, an extrusion die for forming the radiating fins 5 and a press die for manufacturing the unit plates 6 can be used in common. Accordingly, the component manufacturing cost can be greatly reduced.

(Fourth Embodiment)

Figure 6:
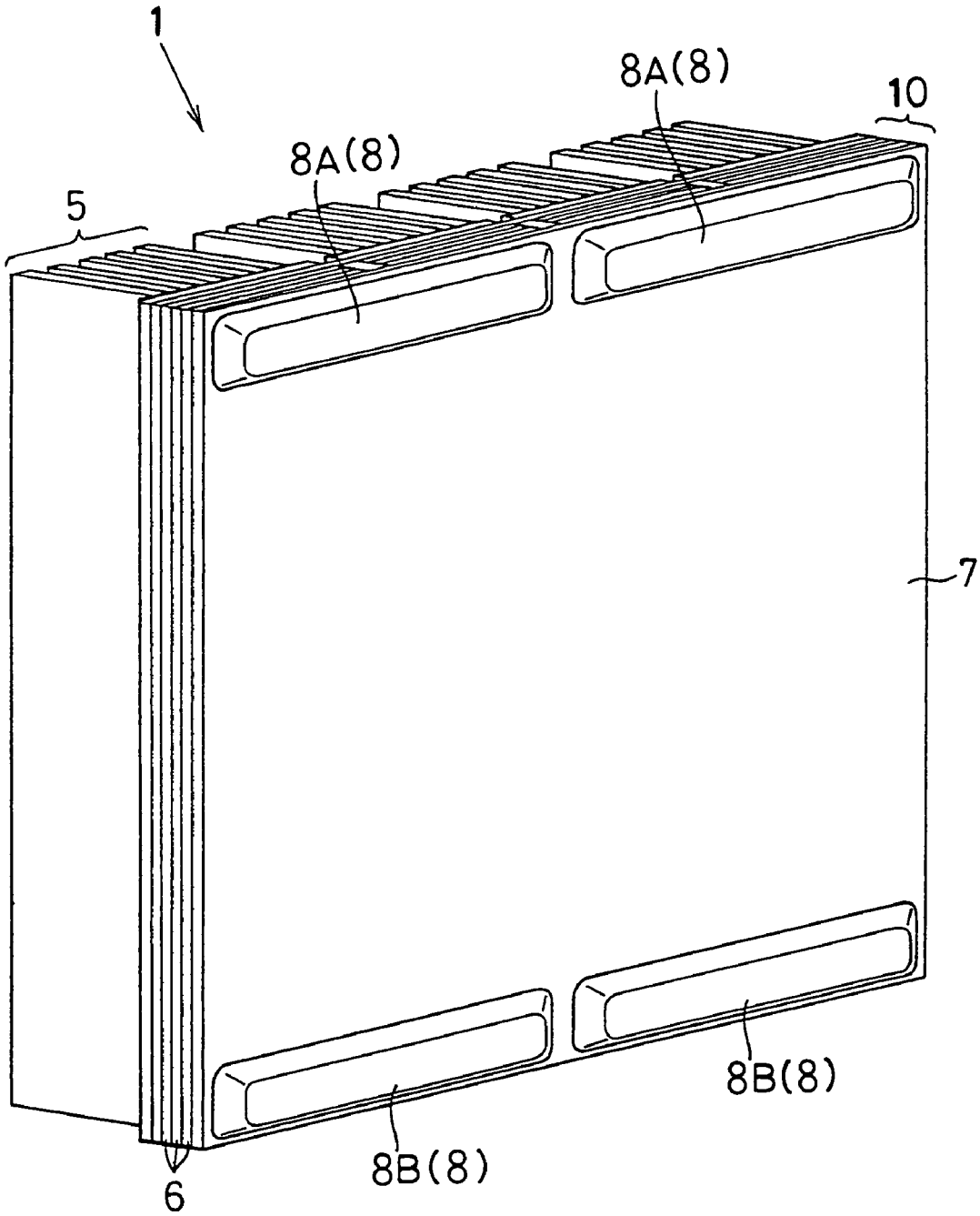
FIG. 6 is a perspective view showing a general shape of a cooling device according to a fourth embodiment.
Figure 7:
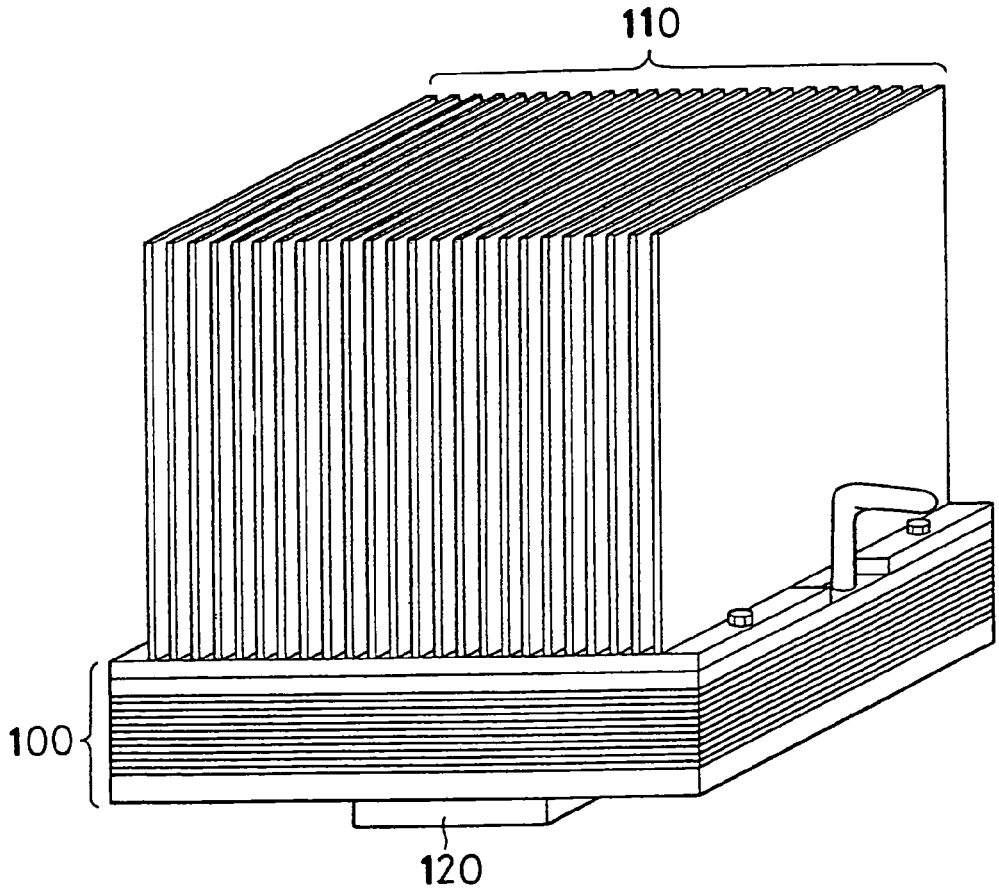
FIG. 7 PRIOR ART
FIG. 7 is a perspective view showing a general shape of a conventional cooling device.

FIG. 6 is a perspective view showing a general shape of a cooling device 1.

The cooling device 1 according to the present embodiment is an another example in which a refrigerant container 10 of hermetically-sealed structure is formed by stacking two sheets of outer plates 7 and plural sheets of unit plates 6 as in the third embodiment.

However, the refrigerant container 10 is constructed such that four sheets of unit plates 6 are arranged in parallel with two sheets of outer plates 7 and four radiating fins 5 are disposed to be arranged in parallel.

According to this structure, it is also possible to divide each of the vapor-side header 8A and the liquid-side header 8B into two parts as shown in FIG. 6. In this case, common components can be used even if the number of the headers 8 is increased.

As in the third embodiment, the number of the unit plates 6 arranged in parallel relative to the two sheets of outer plates 7 and the number of the radiating fins 5 are increased, whereby it is possible to easily enlarge the constitution (size) of the cooling device 1 in accordance with the necessary cooling capacity.

(Fifth Embodiment)

Figure 8:
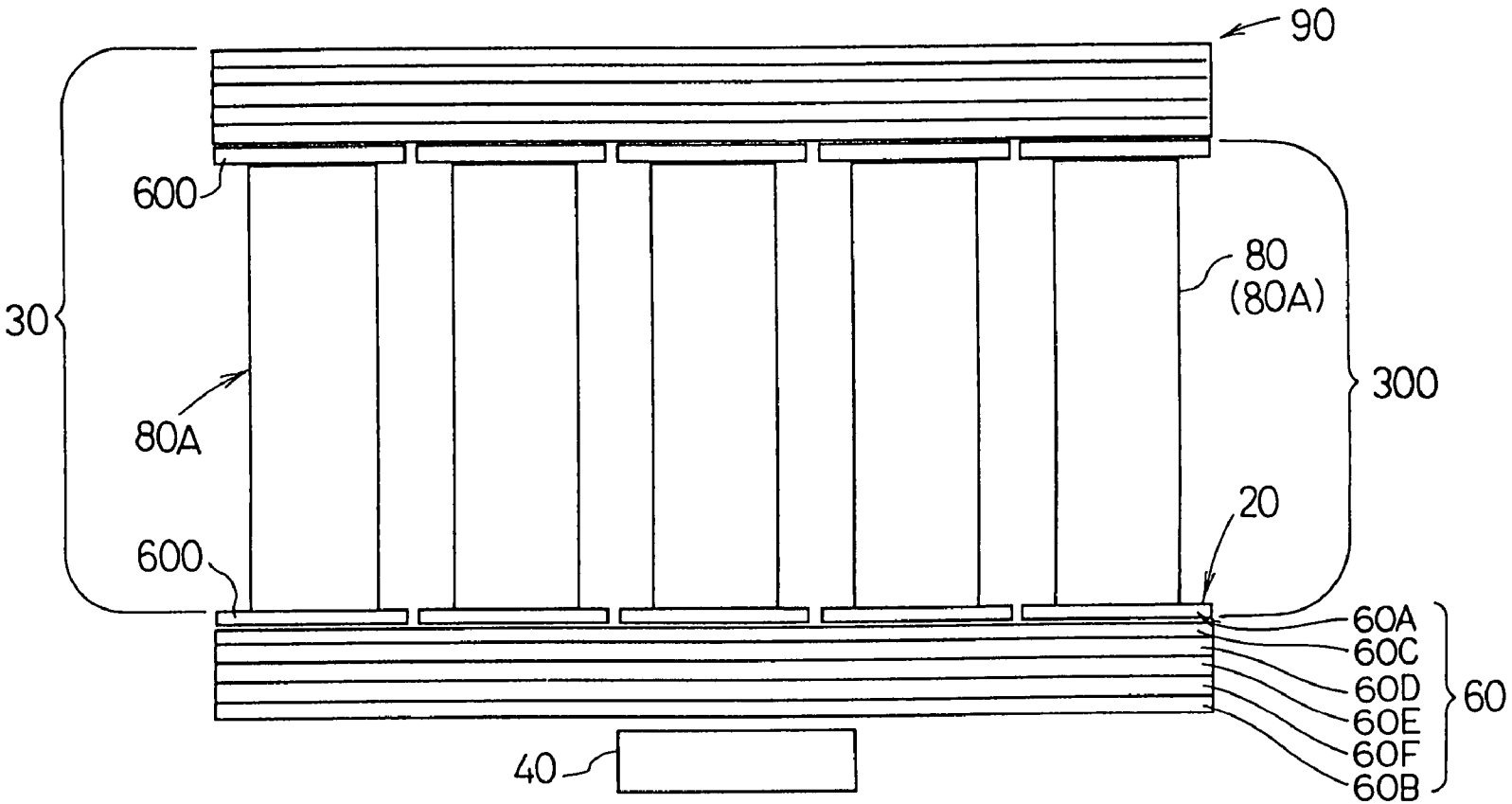
FIG. 8 is a substantially front view of a cooling device according to a fifth embodiment.

FIG. 8 is a side view showing a general shape of a cooling device.

The cooling device according to the fifth embodiment shown in FIG. 8 is constructed by a refrigerant container 20 in which a refrigerant chamber with a predetermined amount of refrigerant sealed therein is formed, and a radiating core portion 30 for dissipating heat of the refrigerant sealed within the refrigerant container 20. One end of the radiating core portion 30 is connected to the refrigerant container 20. The radiating core portion 30 includes a plurality of flat tubes 80 communicating with the interior of the refrigerant container 20, a header tank 90 to which the other ends of the plurality of tubes 80 are connected, for communicating with each tube 80, and radiating fins 101 arranged between adjacent the tubes 80 for thermally contacting the tubes 80.

Each of the tubes 80 is a flat tube, and a tube group 80A is formed by a plurality of (e.g., 16 in the present embodiment) tubes 80 arranged in a row such that their flat surfaces become substantially parallel with one another. A plurality of (e.g., 5 in the present embodiment) tube groups 80A are arranged in parallel. The radiating fins 101 are well-known corrugated fins, and are used to enlarge the radiating area.

The refrigerant container 20 is a laminated structure constructed by superimposing plural sheets (e.g., 6 in the present embodiment) of the plates 60. Six sheets of plates 60 (See FIGS. 9A to 9F) constituting the refrigerant container 20 are press materials obtained by press-cutting, for example, an aluminum plate or a stainless steel plate using a press die. These six sheets of the plates 60 are constructed by a core plate (radiating plate) 60A arranged at the outside of the refrigerant container 20 and connected to the tubes 80, a heat receiving plate 60B arranged at the outside of the refrigerant container 20 so that a heat-generating element 40 is fixed thereon, and intermediate plates 60C to 60F sandwiched between the core plate 60A and the heat receiving plate 60B.

Figure 9A:
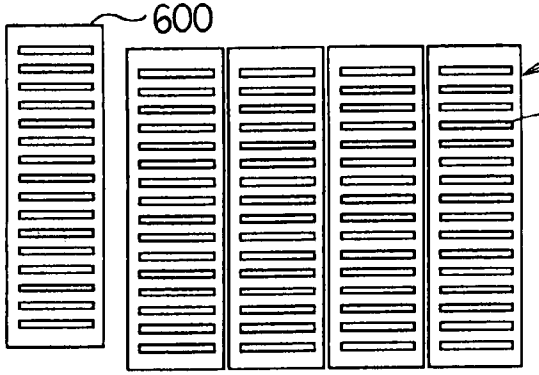
FIGS. 9A to 9F are front views each showing a shape of a plate constituting a refrigerant container and a header tank according to the fifth embodiment.

On the radiating plate 60A (core plate) shown in FIG. 9A, apertures 60*a* communicating with the tubes 80 are provided. The core plate 60A is constructed by plural sheets of unit plates 600 described later.

Figure 9B:
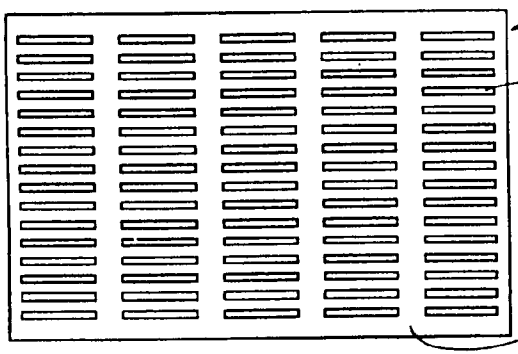
Figure 9C:
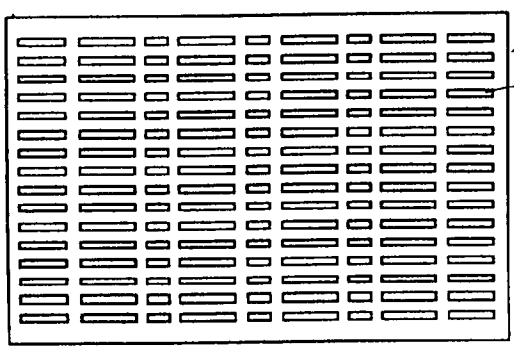
Figure 9D:
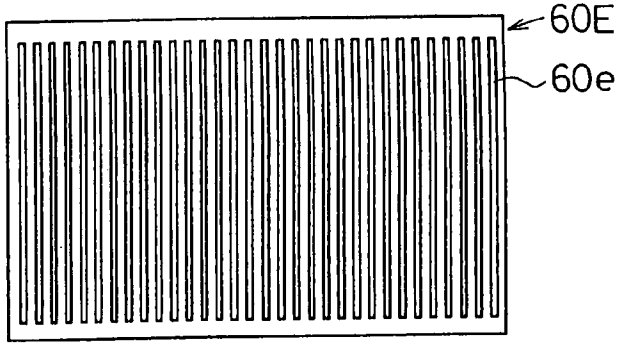
Figure 9E:
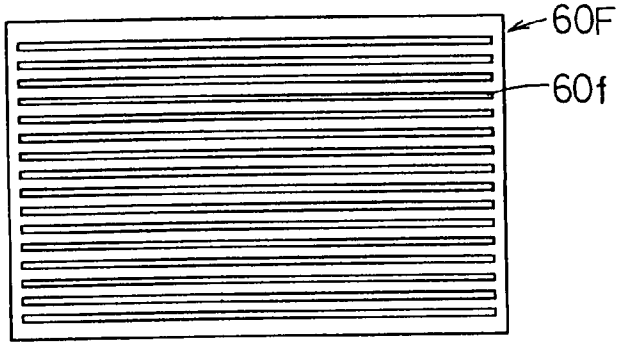
Figure 9F:
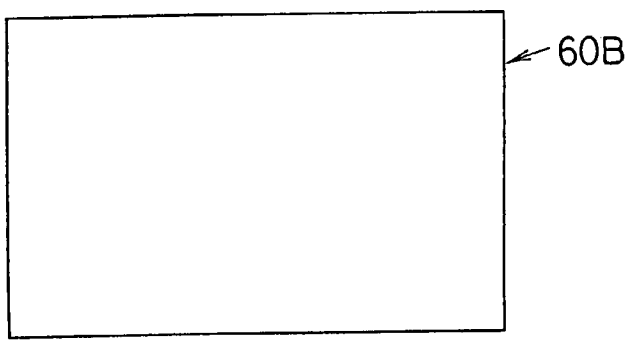

On the intermediate plate 60C shown in FIG. 9B, there are formed a plurality of apertures 60*c*, each communicating to the aperture 60*a* of the core plate 60A. On the intermediate plate 60D shown in FIG. 9C, there are formed a plurality of apertures 60*d*, each communicating to the aperture 60*c*. On the intermediate plate 60E shown in FIG. 9D, a plurality of slit-shaped apertures 60*e* are formed over the substantially entire surface in a vertical direction (a direction perpendicular to the longitudinal direction of the intermediate plate 60E). On the intermediate plate 60F shown in FIG. 9E, a plurality of slit-shaped apertures 60*f* are formed over the substantially entire surface in a lateral direction (longitudinal direction of the intermediate plate 60F).

The core plate 60A, the heat receiving plate 60B, and the intermediate plates 60C–60F are stacked, so that the apertures 60*a* and 60*c* to 60*f* communicate with each other to form the space within the refrigerant container 20.

The header tank 90 is a laminated structure constructed by superimposing plural sheets of plates 60. Since it is the same as the refrigerant container 20 in detailed structure, the detailed description of the structure of the header tank 90 will be omitted.

The core plate 60A is constructed by two or more sheets of (e.g., 5 in the present embodiment) unit plates 600 arranged in parallel in the planar direction. Each of the unit plates 600 for forming the core plate 60A has a size for connecting the tubes 80 in one tube group 80A.

Figure 10:
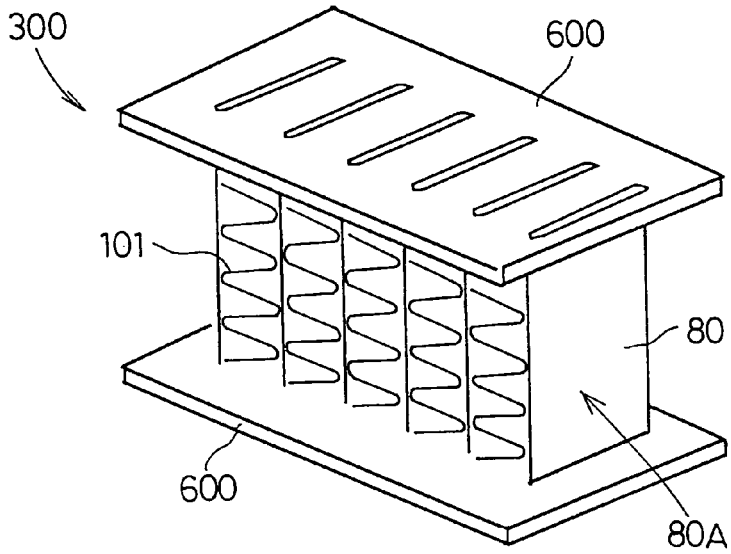
FIG. 10 is a perspective view of a core unit according to the fifth embodiment.

The unit plate 600 on the refrigerant container 20, the tubes 80 in the one tube group 80A, the radiating fins 101 arranged between the tubes 80, and the unit plate 600 on the header tank 90, are assembled together to constitute the core unit 300 as shown in FIG. 10.

Figure 11A:
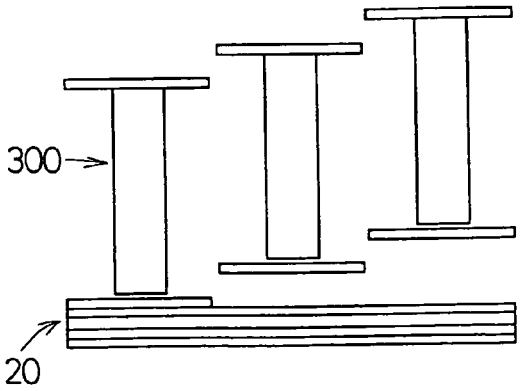
FIGS. 11A and 11B are views for explaining an assembling method of the core unit according to the fifth embodiment, where
Figure 11B:
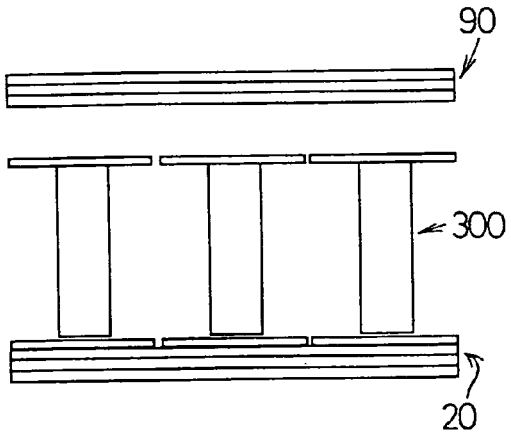

The heat receiving plate 60B and the intermediate plates 60C to 60F have size substantially equal to the general shape of five sheets of unit plates 600 arranged in parallel, and they are stacked to constitute the refrigerant container 20. As shown in FIG. 11A, above the heat receiving plate 60B and the intermediate plates 60C–60F, a plurality of the core units 300 are installed. Further, the core plate 60B and the intermediate plates 60C–60F of the header tank 90 are assembled above the core units 300, whereby the cooling device is assembled. After the cooling device is assembled in this manner, the cooling device is integrally brazed in, for example, vacuum atmosphere.

In this respect, in an area opposite to a borderline between the core unit 300 and the core unit 300 of the intermediate plate 60C, that is, a clearance between the unit plates 600 adjacent to each other, there is provided a seal portion 60*b* shown in FIG. 9B for sealing this clearance. The seal portion 60*b* prevents the refrigerant sealed within the refrigerant container 20 from leaking to the outside through the clearance between the unit plates 600 adjacent to each other.

Subsequently, an operation according to the fifth embodiment will be now described.

In the cooling device according to the fifth embodiment, as shown in FIG. 8, the heat-generating element 40 is arranged below the refrigerant container 20, and the radiating core portion 30 is arranged above the refrigerant container 20.

The refrigerant stored in the refrigerant container 20 is boiled and evaporated by heat from the heat-generating element 40, and flows into the header tank 90 through tubes 80 arranged in an area in which the heat-generating element 40 is mounted, and in its vicinity. The refrigerant vapor flowing into the header tank 90 is cooled and condensed while spreading within the header tank 90. Condensed liquid refrigerant flows back to the refrigerant container 20 through other tubes 80 (i.e., tubes 80 arranged in the outside of the range in which the heat-generating element 4 is mounted). Thus, the heat of the heat-generating element 40 is transmitted to the refrigerant, and is transported to the radiating core portion 30. While the refrigerant vapor condenses in the radiating core portion 30, the heat is dissipated as latent heat of condensation, and is dissipated into the outside air through the radiating fins 101.

Figure 12A:
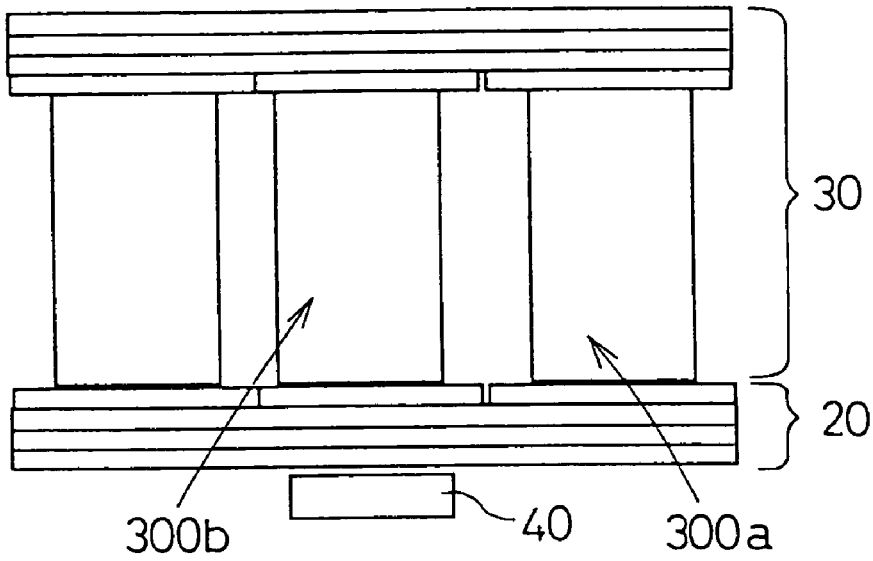
FIG. 12A is a substantially front view of a cooling device according to a modification of the fifth embodiment.
Figure 12B:
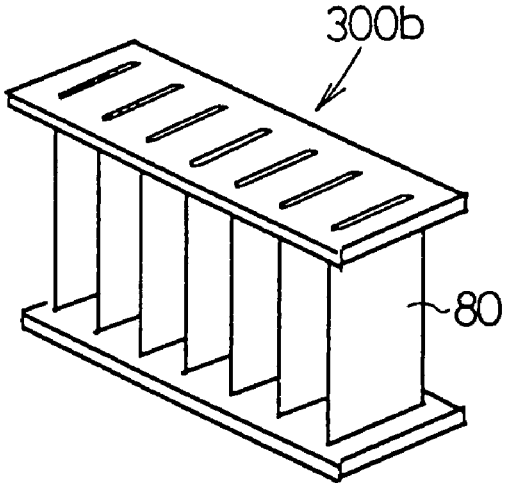
FIGS. 12B and 12C are perspective views each showing a core unit to be installed to the cooling device of FIG. 12A.
Figure 12C:
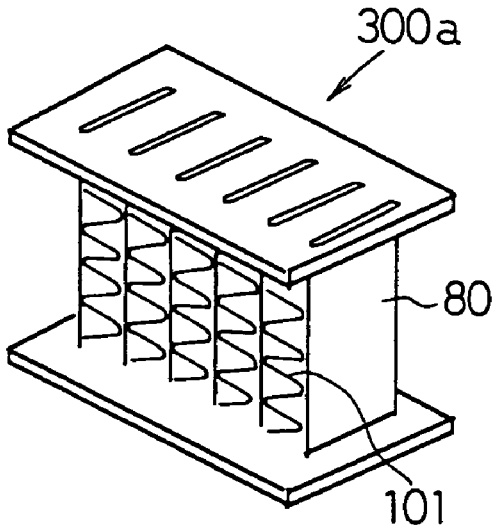

In the fifth embodiment, since the core plate 60A is constructed by the plural unit plates 600, the radiating core portion 30 can be divided into a plurality of the core units 300 for each tube group 80A. With such construction, by combining the core units 300 different from each other, it is possible to easily change the heat dissipation performance of the radiating core portion 30 in accordance with the necessary amount of heat dissipation. Specifically, in a cooling device as shown in FIG. 12A, a core unit 300*b* (See FIG. 12B) without radiating fin 101 can be disposed at the central part of the radiating core portion 30, and core units 300*a* (See FIG. 12C) with the radiating fins 101 can be disposed at both sides of the core unit 300*b*. With such combination, it is possible to adjust a flow resistance of cooling air in the entire cooling device shown in FIG. 12A.

Figure 13A:
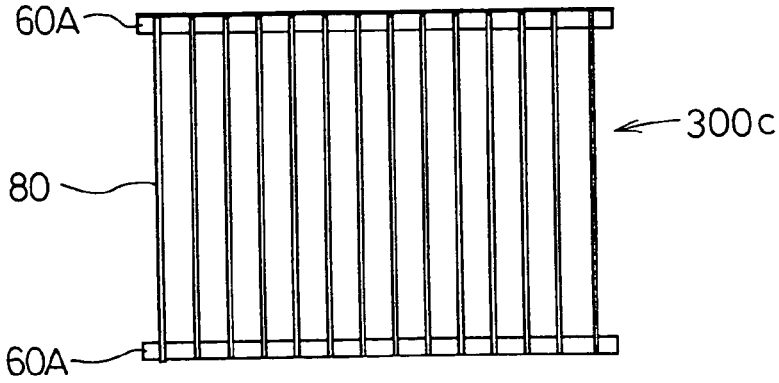
FIGS. 13A and 13B are substantially front view each showing a core unit according to a modification of the fifth embodiment.
Figure 13B:
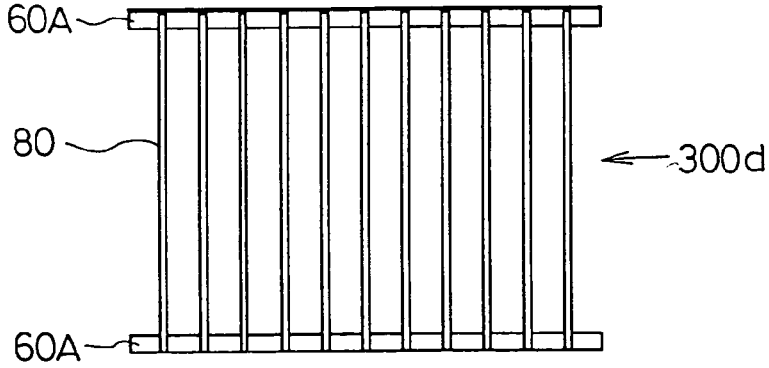
Figure 14:
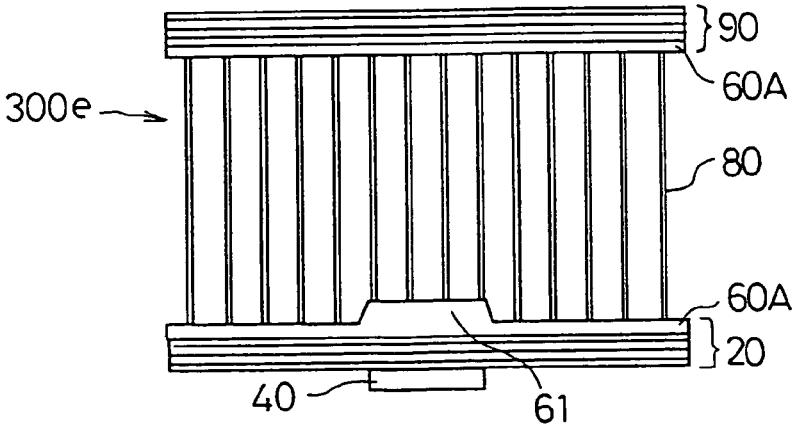
FIG. 14 is a substantially front view of a cooling device according to a modification of the fifth embodiment.

Core units 300*c*, 300*d* having different tube pitches respectively shown in FIGS. 13A and 13B are combined, whereby it is also possible to adjust pressure loss of refrigerant. Further, as shown in FIG. 14, it is possible to have construction in which the capacity of the refrigerant container 20 is locally made larger through the use of a core plate 60A having a protruding portion 61 only for a core unit 300*e* arranged in the vicinity of the heat-generating element 40. With such construction, it is possible to increase an amount of refrigerant passage in the vicinity of the heat-generating element 40, and it is possible to cool a heat-generating element having larger heat-generating amount.

Particularly, in the present embodiment, in order to install the core unit 300 to the refrigerant container 20 and the header tank 90 after assembling the core plate 600, the tubes 80 and the fins 101 as the core unit 300, there is no need for any special jig, but the fin 101 can be easily installed between the tubes 80.

Since the tube group 80A, in which flat surfaces of the tubes 80 are arranged so as to become substantially parallel, is used for one core unit 300, the fins 101 can be easily installed between the tubes 80 in the tube group 80A.

Figure 15A:
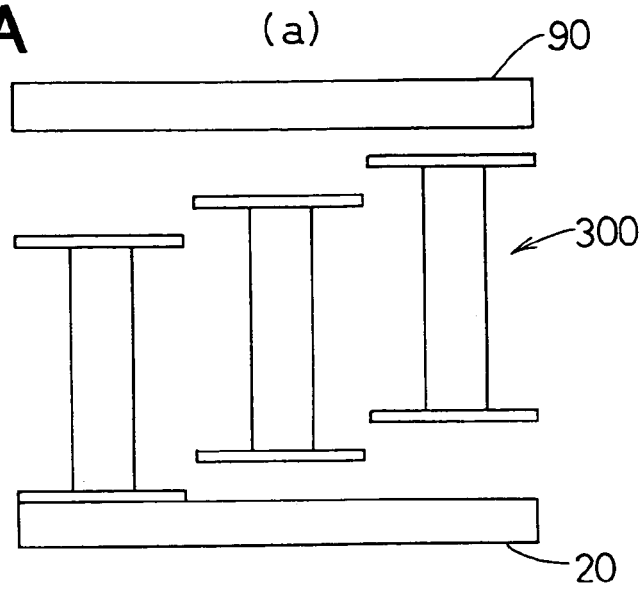
FIGS. 15A, 15B and 15C are views according to a modification of the fifth embodiment, where
Figure 15B:
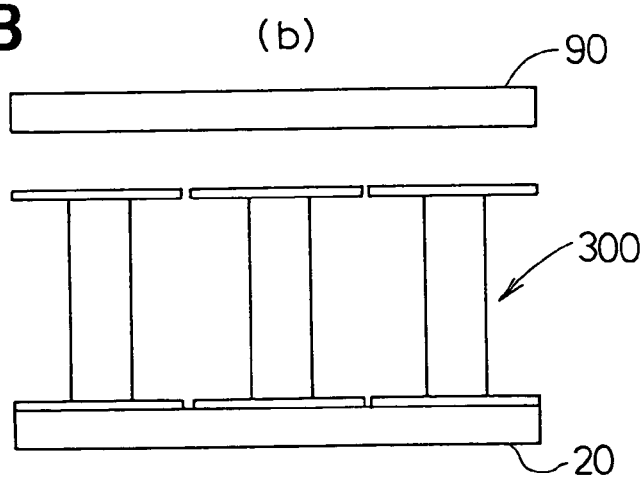
Figure 15C:
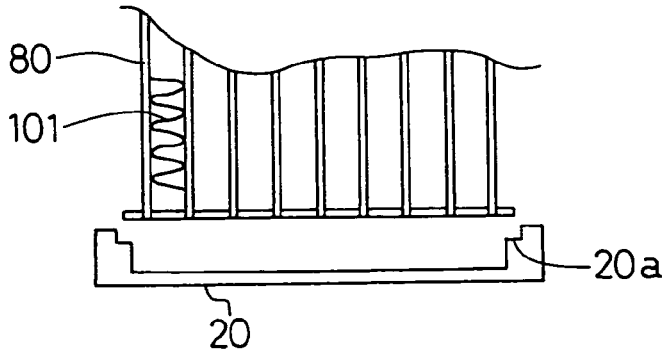

In this respect, in the above-described embodiment, each of the refrigerant container 20 and the header tank 90 is a laminated structure. However, as shown in FIGS. 15A–15C, each of the refrigerant container 20 and the header tank 90 may be made into a hollow-body. When the refrigerant container 20 and the header tank 90 are formed into a hollow-body respectively, at the open-ended edge of the refrigerant container 20 and the header tank 90, a step portion 20*a* can be formed as shown in FIG. 15C. In this case, the edge portion of the core plate 60A is formed to contact the step portion 20*a*. Because the step portion 20*a* is formed at the open-ended edge of the refrigerant container 20 and the header tank 90 as described above, an assembling position of the core unit 300 can be readily determined. All core units 300 of the radiating core portion 30 can be formed by a construction in which no radiating fin 101 is arranged between the tubes 80.

(Sixth Embodiment)

Figure 16A:
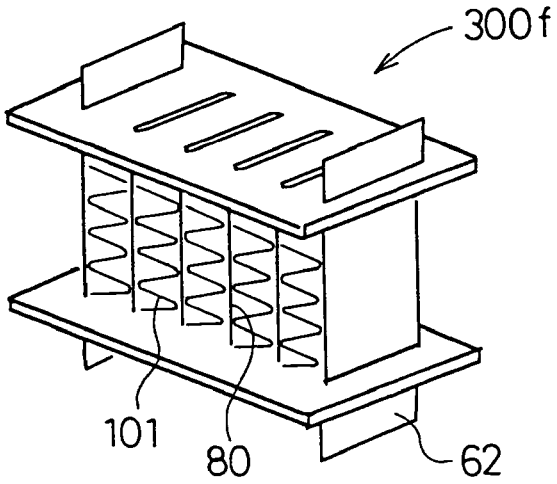
FIG. 16A is a perspective view of a core unit according to a sixth embodiment.
Figure 16B:
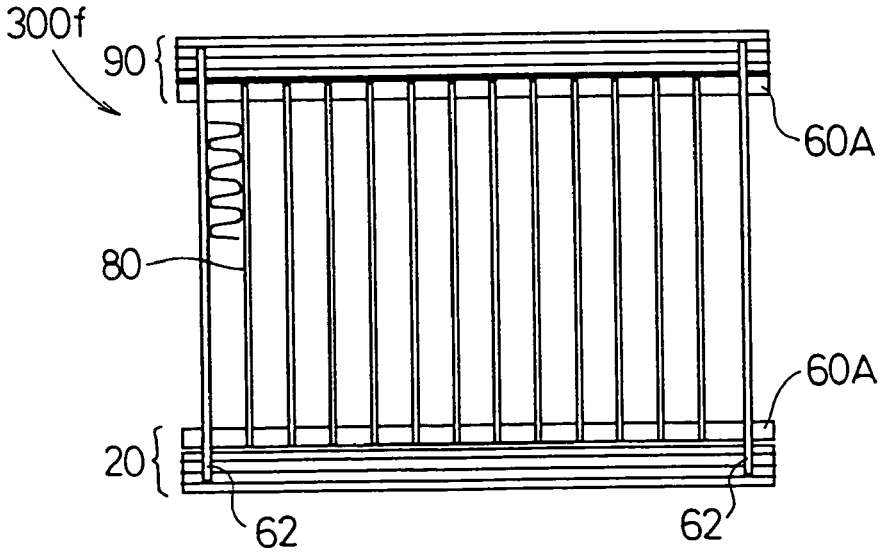
FIG. 16B is a substantially cross-sectional view of a cooling device according to the sixth embodiment.

In the fifth embodiment, the description has been made of the cooling device using the core unit having the radiating plate, the tube and the fin. However, in the sixth embodiment, a core unit 300*f*, in which an insert 62 is provided at the outermost tube 80 as shown in FIGS. 16A and 16B, can be used. The insert 62 is a plate-shaped member made of, for example, aluminum plate or stainless steel plate, and both end portions thereof are inserted into apertures formed in the core plates 60A. On the intermediate plates 60C–60F to be assembled to the core unit 300*f*, apertures through which both end portions of the insert 62 are inserted are formed. The end portions of the insert 62 are inserted into this apertures, so that the position of each plate 60C to 60F is set.

In the present embodiment, because both sides of the core unit 300*f* are fixed by the inserts 62, it can prevent the tubes 80 from being removed from the core plate 60A during transportation of the core unit 300*f*, for example, during assembling.

(Seventh Embodiment)

Figure 17A:
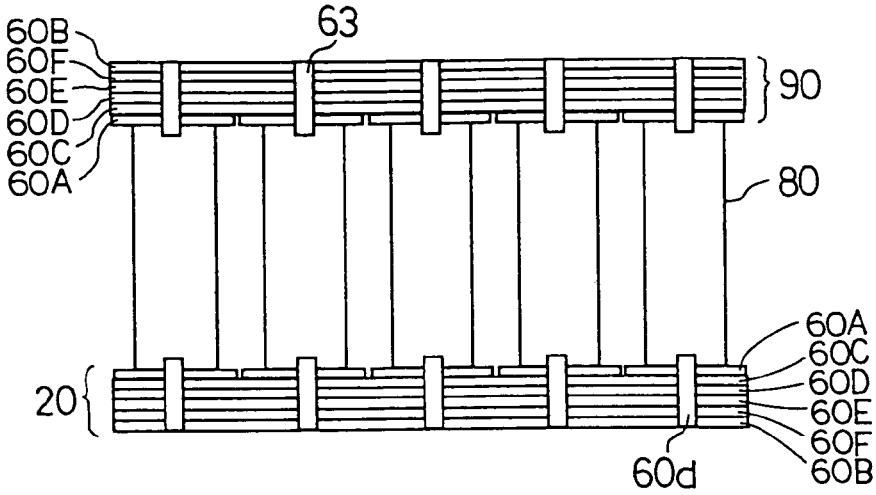
FIG. 17A is a view showing a cooling device according to a seventh embodiment when being viewed from a direction substantially perpendicular to an air-flowing direction.
Figure 17B:
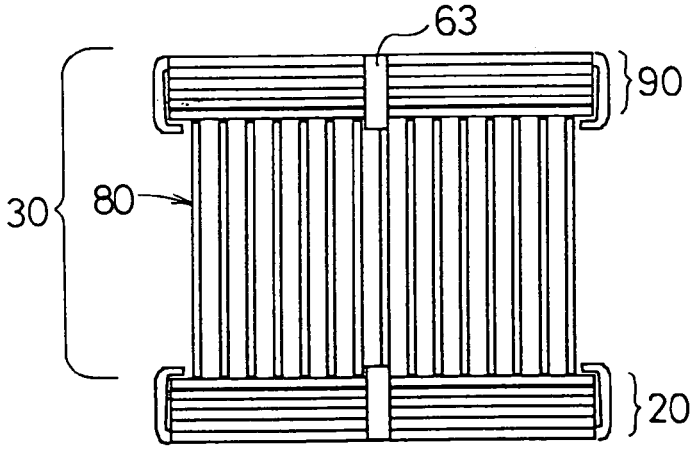
FIG. 17B is a view of the cooling device according to the seventh embodiment when being viewed from the air-flowing direction.
Figure 18:
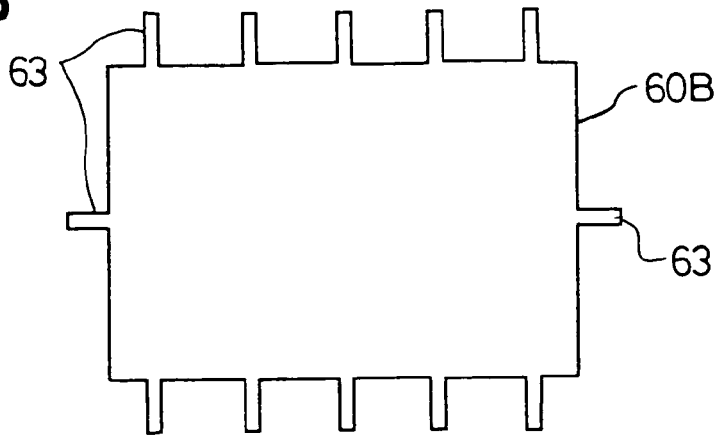
FIG. 18 is a plan view showing a plate in the seventh embodiment.

As shown in FIGS. 17A, 17B and 18, in the seventh embodiment, among the plates 60 constituting the refrigerant container 20 and the header tank 90, a heat receiving plate 60B arranged outermost is provided with a pawl portion 63, and the other plates 60A, 60C–60F are fastened and fixed by the pawl portion 63. In the assembling of the cooling device, the core plates 60A and the intermediate plates 60C–60F laminated to each other are caulked and fixed by the pawl portion 63, and therefore, brazing can be readily performed without using any special fixing jig.

(Eighth Embodiment)

Figure 19A:
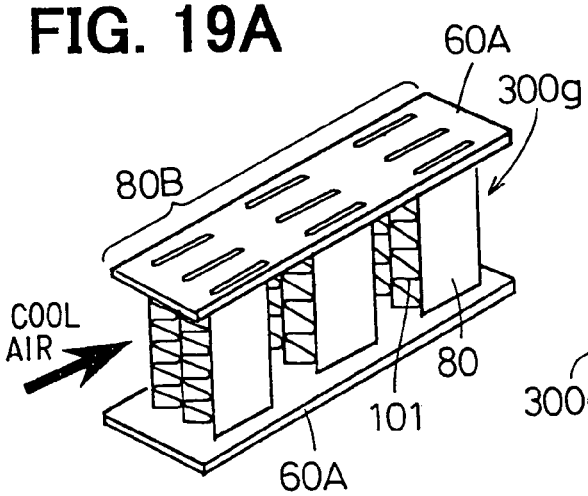
FIG. 19A is a perspective view showing a core unit according to an eighth embodiment.
Figure 19B:
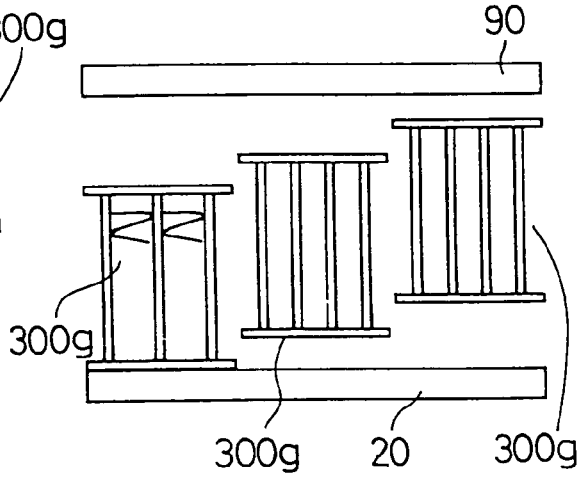
FIG. 19B is a schematic diagram showing an assembling method of the cooling device in the eighth embodiment.

For a tube group constituting the core unit 300, tubes 80 arranged in parallel in the same direction as the air-flowing direction as shown in FIGS. 19A and 19B are used as one tube group 80B, and the tube group 80B can be used to form a core unit 300*g* of the eighth embodiment.

(Ninth Embodiment)

In the above-described embodiments, the wave-shaped corrugate fins are used as the radiating fins. However, in the ninth embodiment, fins formed by bending plate material in a U-shape as described later can be used.

Figure 20:
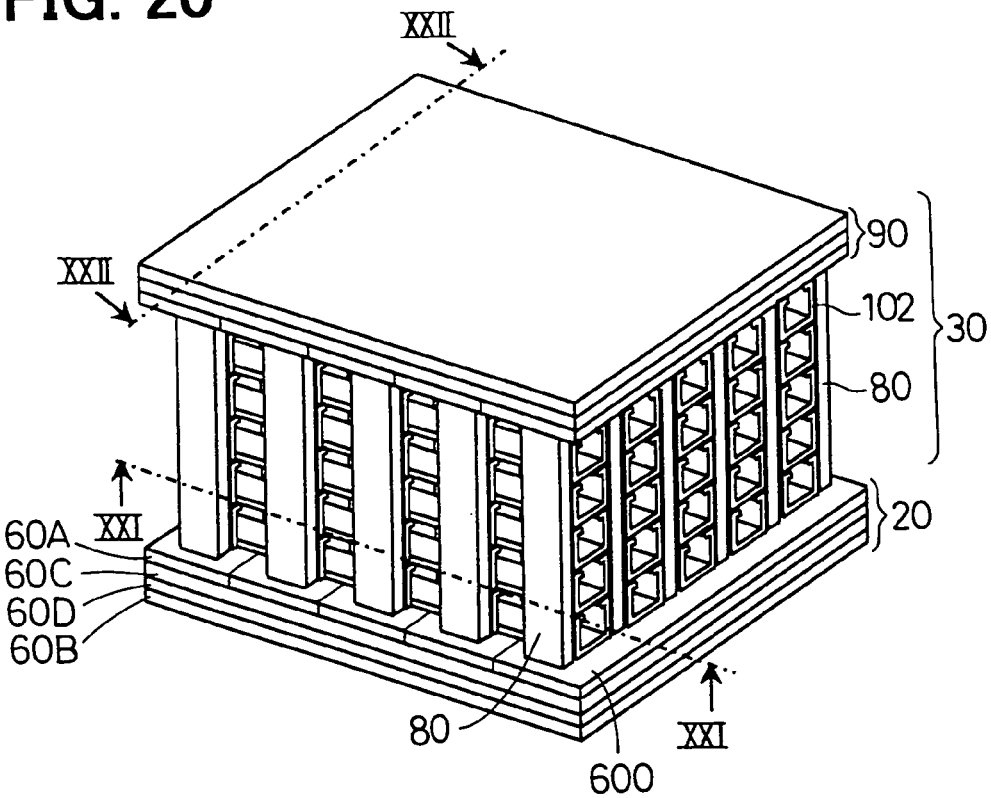
FIG. 20 is a perspective view showing a cooling device according to a ninth embodiment.
Figure 21:
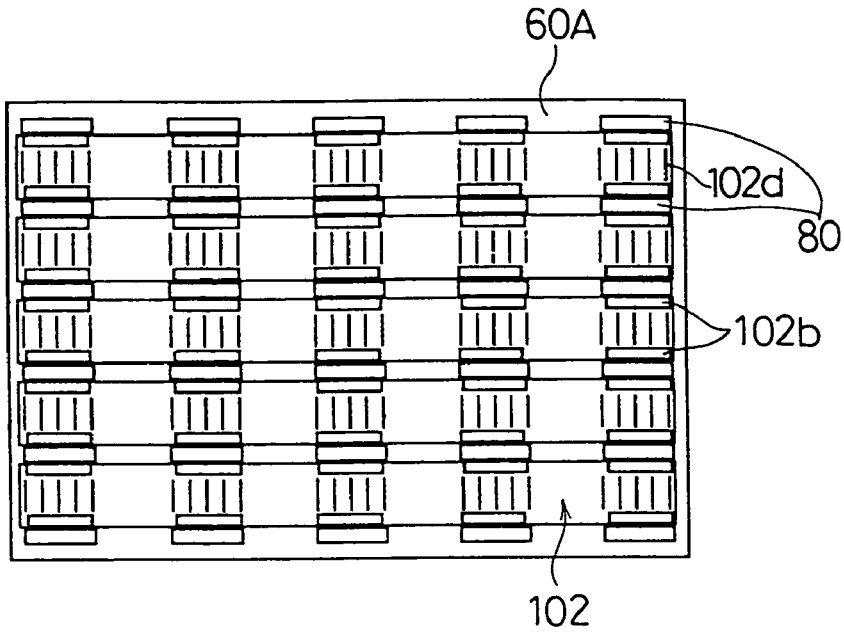
FIG. 21 is a cross-sectional view taken on line XXI—XXI of FIG. 20.
Figure 22:
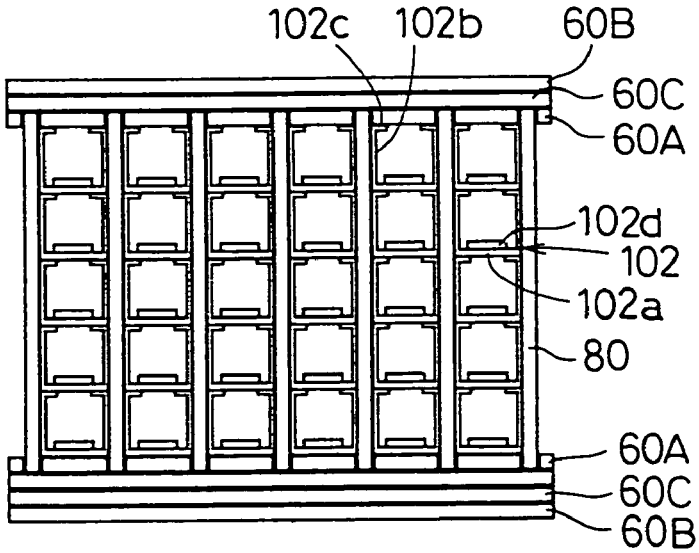
FIG. 22 is a cross-sectional view taken on line XXII—XXII of FIG. 20.
Figure 23:
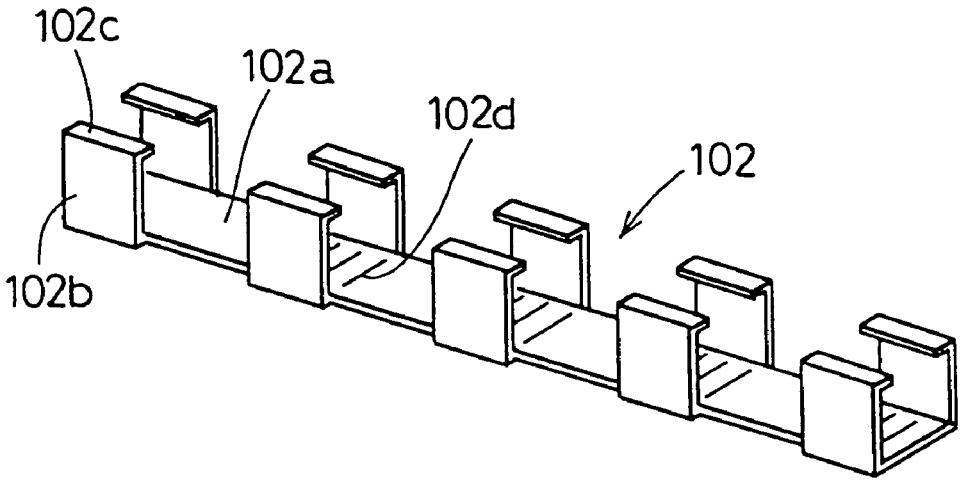
FIG. 23 is a perspective view showing a fin according to the ninth embodiment.
Figure 26:
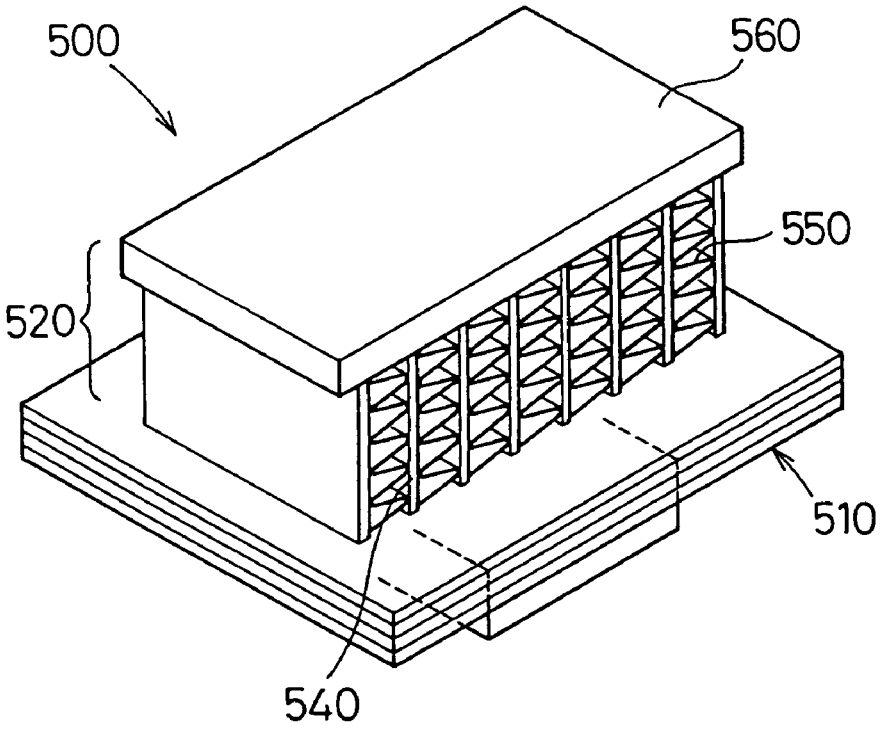
FIG. 26 PRIOR ART
FIG. 26 is a perspective view showing a general shape of a cooling device according to the prior art.

FIG. 20 is a perspective view of a cooling device according to the ninth embodiment, FIG. 21 is a cross-sectional view taken on line XXI—XXI of FIG. 20, and FIG. 22 is a cross-sectional view taken on line XXII—XXII of FIG. 20. FIG. 23 is a perspective view of a radiating fin according to the ninth embodiment. The cooling device is constructed by the refrigerant container 20 and the radiating core portion 30 as shown in FIG. 20. In this respect, portions identical to those in the fifth embodiment are designated by the identical reference numerals, and detailed description thereof will be omitted.

The refrigerant container 20 is constructed by plural sheets of (e.g., four sheets in the present embodiment) plates 60 stacked. Among the plates 60, a plate arranged on the side of the radiating core portion 30 is a core plate 60A which consists of plural sheets of unit plates 600 arranged in parallel in the planar direction on each unit plate 600, there is provided apertures (not shown) into which one side ends of the tubes 80 are inserted. Among the plates 60, the outermost (below in FIG. 20) plate is a heat receiving plate 60B. At the central part of the bottom surface of the heat receiving plate 60B, a heat-generating element (not shown) is attached. Plates to be arranged between the core plate 60A and the heat receiving plate 60B are intermediate plates 60C, 60D. Apertures (not shown) for communicating with the tubes 80 are provided in the intermediate plates 60C, 60D.

The header tank 90 arranged above the tubes 80 is constructed by plural sheets (e.g., three sheets in the present embodiment) of plates 60 stacked. Among the plates 60, a plate arranged on the side of the refrigerant container 20 is a core plate 60A which consists of plural sheets of unit plates 600 arranged in parallel in the planar direction. Each unit plate 600 has apertures (not shown) into which the other side ends of the tubes 80 are inserted.

A fin 102 made of a plate material has a base portion 102*a* extending in the width direction (i.e., the same direction as the air-flowing direction) of the radiating core portion 30, a wall portion 102*b* bent substantially perpendicularly from the base portion 102*a* to contact the wall surface of the tube 80 and to be brazed thereto, and a bent portion 102*c* substantially perpendicularly bent from the wall portion 102*b*. The base portion 102*a* extends substantially over the whole length in the air-flowing direction of the radiating core portion 30. The base portion 102*a* has an upstream-side wall portion for abutting against the tube 80 on the most upstream air side, and a downstream-side wall portion 111*b* for abutting against the tube 80 on the most downstream air side. A part of the base portion 102*a* of the fin 102, on the vicinity of the wall portion 102*b*, is cut to be raised, to form a louver 102*d* which improves the heat dissipation performance.

The fin 102 is installed by inserting it between the tube 80 and the tube 80 adjacent to each other, and is stacked in the longitudinal direction of the tubes 80. At this time, the bent portion 102*c* and the base portion 102*a* of the fins 102 to be stacked upwardly abut against each other. A predetermined interval is given between the base portions 102*a* of the fins 102, to define an air passage through which air passes.

As described above, in the present embodiment, since the base portion 102*a* of the fin 102 extend over the substantially whole length of the radiating core portion 30 in the air-flowing direction, the fin 102 is inserted between the adjacent tubes 80, whereby the installation of the fin 102 can be made and the assembling operation can be more easily performed than in the conventional construction. Since a plurality of the fins 102 are stacked at predetermined intervals in the longitudinal direction of the tube 80, when the fins 102 are assembled to the radiating core portion 30, an amount of protrusion of the tube 80 with respect to the core plate 60A can be set by the height of the stacked fins 102.

In addition, the bent portion 102*c* of the fin 102 arranged at the highest position and the core plate 60A on the header tank 90 abut against each other, and the base portion 102*a* of the fin 102 arranged at the lowest position and the core plate 60A on the refrigerant container 20 abut against each other. Therefore, the root of the tube 80 can be held during brazing. Further, even if there is a clearance between the aperture of the core plate 60A and the tube 80, it is possible to supply brazing material from the fins 102, and it can prevent the root of the tube 80 from being improperly brazed.

In this respect, in the above-described embodiment, the base portion 102*a* is provided with the louver 102*d*. However, a fin without any louver may be used. In the above-described embodiment, all wall portions 102*b* formed on the base portion 102*a* are brazed to the wall surface of the tube 80 for abutting. However, the tube wall surface in the vicinity of the central part of the radiating core portion is not brazed to the wall portion of the fin, while the wall surface of the tubes in the side part of the radiating core portion is brazed to the wall portion of the fin.

(Tenth Embodiment)

Figure 24A:
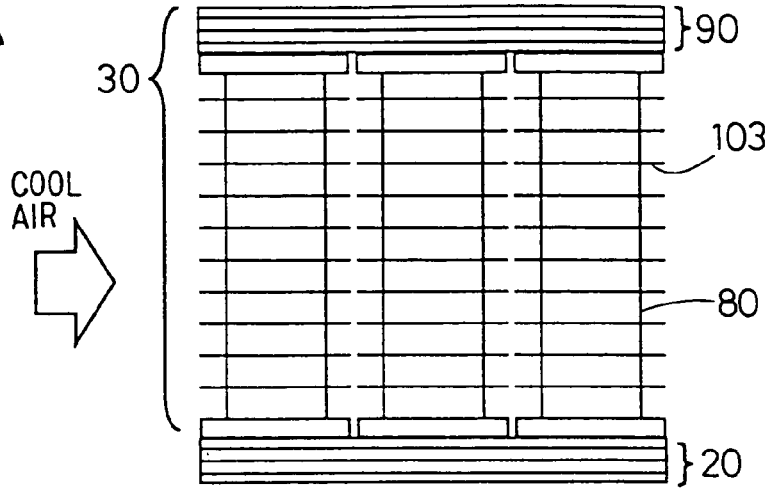
FIG. 24A is a side view of a cooling device according to a tenth embodiment when being viewed from a direction substantially perpendicular to the air-flowing direction.
Figure 24B:
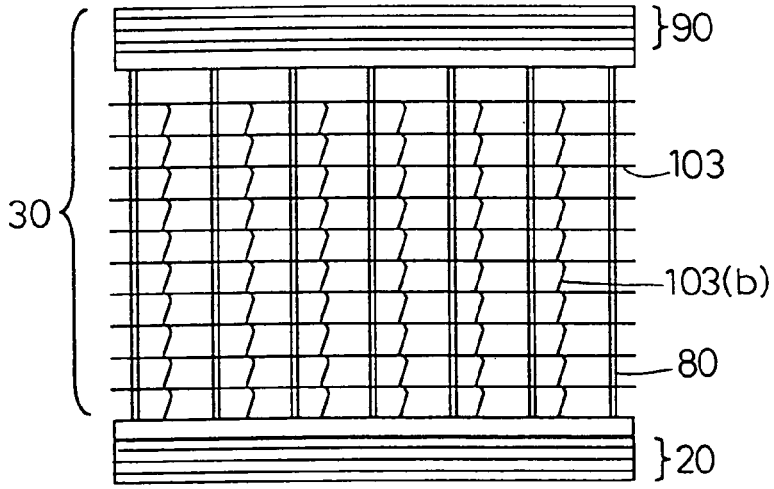
FIG. 24B is a side view of the cooling device according to the tenth embodiment when being viewed from the air-flowing direction.
Figure 25:
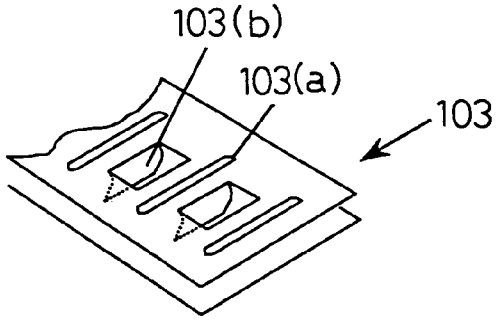
FIG. 25 is a perspective view showing a part of a fin according to the tenth embodiment.

In the tenth embodiment, a plate fin is used as a radiating fin. FIGS. 24A and 24B are views showing a cooling device according to the present embodiment. FIG. 24A is a view when being viewed from a direction substantially perpendicular to the air-flowing direction, and FIG. 24B is a view when being viewed from the air-flowing direction. FIG. 25 is a perspective view showing a part of fins applicable to the present embodiment. In this respect, portions identical to those in the fifth embodiment are designated by the identical reference numerals, and detailed description will be omitted.

The tube 80 are inserted into plural plate fins 103. The plate fin 103 has an aperture 103*a* into which the tube 80 is inserted, and a raised portion 103*b* is used as a louver. This raised portion 103*b* has a height to abut against a plate fin 103 stacked adjacent, and is used as an interval retaining member for retaining the interval between the plate fins 103.

According to the tenth embodiment, the interval between the adjacent plate fins 103 can be maintained by using the raised portion 103*b* without using any assembling jig. Therefore, it is capable of improving the work efficiency in the assembling operation.

What is claim is:

1. A cooling device for cooling a heat-generating element, comprising:

a plurality of tubes in which refrigerant flows;

a refrigerant container in which refrigerant is sealed, the refrigerant container having a plurality of unit plates connected to one side ends of the tubes to communicate with the tubes, and having a surface onto which the heat-generating element is attached; and a header tank having a plurality of unit plates connected to the other side ends of the tubes, through which the tubes communicate with each other, wherein:

refrigerant boiled and vaporized within the refrigerant container by heat from the heat-generating element flows into the tubes to perform heat exchange with outside air;

the tubes arranged in parallel in each unit plate construct a tube group;

the tubes in the tube group are inserted into the unit plate of the refrigerant container and the unit plate of the header tank to construct a core unit; and a plurality of the core units are arranged.

2. The cooling device according to claim 1, wherein the tube group is constructed by the tubes arranged in parallel in a direction crossing with an air-flowing direction.

3. The cooling device according to claim 1, wherein the tube group is constructed by the tubes arranged in parallel in the air-flowing direction.

4. The cooling device according to claim 1, wherein each of the refrigerant container and the header tank is a laminated structure in which a plurality of flat plate members are laminated.

5. The cooling device according to claim 1, wherein the core unit has a plurality of fins each of which is disposed between adjacent tubes.

6. The cooling device according to claim 5, wherein the fin is a corrugate fin.

7. The cooling device according to claim 1, wherein the core units having different air-flowing resistances are arranged.

8. The cooling device according to claim 1, wherein the core units having different intervals between adjacent the tubes are arranged.

9. The cooling device according to claim 1, wherein the tube group includes an outer tube at an outermost side in the laminating direction of the tubes, and the outer tube has an insert inserted into the unit plate.

10. The cooling device according to claim 4, wherein:

among the flat plate members, a flat plate member arranged on the outermost side has a pawl; and the flat plate members are fixed by the pawl.

11. The cooling device according to claim 1, wherein the tube is a flat tube.

12. The cooling device according to claim 5, wherein:

each of the fins has a plate-like base portion extending in the air-flowing direction, and a wall portion bent from the base portion, for abutting against a wall surface of the tube; and the fins are stacked in a tube longitudinal direction.

13. The cooling device according to claim 12, wherein:

the base portion of each fin has an upstream wall portion contacting the tube positioned on the most upstream air side, and a downstream wall portion contacting the tube positioned on the most downstream air side; and the base portion extends from the tube positioned on the most upstream air side to the tube positioned on the most downstream air side.

* * * * *